US006692150B2

(12) United States Patent
Hoshino

(10) Patent No.: US 6,692,150 B2
(45) Date of Patent: Feb. 17, 2004

(54) EASILY OPENABLE DISPOSABLE CONTAINER, AND SEALING DIE THEREFOR

(75) Inventor: Takahiro Hoshino, Kanagawa (JP)

(73) Assignee: Solvex Co., Kawasaki (JP)

( * ) Notice: Subject to any disclaimer, the term of this patent is extended or adjusted under 35 U.S.C. 154(b) by 0 days.

(21) Appl. No.: 10/040,432

(22) Filed: Jan. 9, 2002

(65) Prior Publication Data

US 2002/0094141 A1 Jul. 18, 2002

(30) Foreign Application Priority Data

Jan. 16, 2001 (JP) ..... 2001-007877
Dec. 14, 2001 (JP) ..... 2001-381121

(51) Int. Cl.[7] ..... B65D 33/00
(52) U.S. Cl. ..... 383/210
(58) Field of Search ..... 383/210

(56) References Cited

U.S. PATENT DOCUMENTS 5,263,609 A * 11/1993 Hoshino ..... 222/92

FOREIGN PATENT DOCUMENTS

DE 004107350 A * 9/1992 ..... 383/210
EP 000496587 A * 7/1992 ..... 383/210
JP 6-19473 5/1994
JP 6-21862 6/1994
JP 7-23408 5/1995
JP 8-10561 3/1996

* cited by examiner

*Primary Examiner*—Jes F. Pascua
(74) *Attorney, Agent, or Firm*—Armstrong, Kratz, Quintos, Hanson & Brooks, LLP

(57) ABSTRACT

The present invention is a disposable container having an easily openable structure capable of solving the problems in the easily openable disposable containers, and a die therefore at a low cost. An easily openable disposable container comprising a sheet such as a synthetic resin film or a film-like sheet with an aluminum foil laminated on the film for sealing the substance to be stored by sealing the entirety or a part of the periphery with a content such as a liquid or a particle, with an easily openable part formed in a part of the sealed parts, wherein the sealing of the easily openable part is formed in a width narrower than the sealing width in the other part of the sealed part, and a narrow width vertical sealing is formed continuously from the narrow width sealed part, elongating in the direction substantially orthogonal thereto into the inside of the container such that the sealing of the easily openable part forms a substantially T-shape or a substantially V-shape in a plan view, is provided.

4 Claims, 7 Drawing Sheets

EASILY OPENABLE DISPOSABLE CONTAINER, AND SEALING DIE THEREFOR

BACKGROUND OF THE INVENTION

1. Field of the Invention

The present invention relates to an easily openable disposable container for filling and sealing a liquid or paste-like content such as a seasoning, a detergent, a cosmetic, or a particle-like content, capable of forming an open part in a part of the sealed part with the seal of the sealed part peeled off for pressing out the content to the outside of the container by pressuring the contained with the palms or fingers in the case the user would like to take out the sealed content, and a sealing die therefor.

2. Description of the Related Art

The present inventor has proposed a large number of patent applications and utility model applications including the Japanese Patent Utility Model Publication (JP-B) Nos. 6-19473, 6-21862, 7-23408, and 8-10561 concerning a disposable container provided with an easily openable function or structure.

According to the easily openable disposable containers, which have been proposed by the present inventor, the initial object was achieved in terms of providing an easily openable function to a container. However, a die needed for realizing the sealing structure for the easily openable function is complicated, and thus a problem is involved in that the production thereof takes labor so as to soar the cost, and it is reflected to the production cost of the container.

Moreover, according to the disposable containers, which have been proposed by the present inventor, in relation to the sealing structure of the easily openable part, since the easily openable part is opened by the opening operation of generating the opening pressure to the content by pressuring the container itself with the fingers, in the case the content is liquid, the content stored therein is scattered to the outside at the time the container is opened, and thus it is problematic.

Furthermore, depending on the liquid content stored in the container, the content is filled to a position higher than a lateral sealing position so as to execute the submerged sealing. In this case, since the content is adhered at the opening part, and thus a problem in terms of the hygiene or the external appearance is also concerned.

Moreover, since a sealing die for the disposable container comprising the above-mentioned special opening function needs to be produced independently from a die for ordinary sealing, the die cost is reflected to the above-mentioned disposable container cost, and thus it is problematic.

SUMMARY OF THE INVENTION

Accordingly, an object of the present invention is to provide a disposable container having an easily openable structure, capable of solving the problems in the easily openable disposable containers, which have been proposed by the present inventor, and a low cost die therefor.

An easily openable disposable container according to the present invention for solving the above-mentioned problems has a configuration of a disposable container comprising a sheet such as a synthetic resin film or a film-like sheet with an aluminum foil laminated on the film for sealing the substance to be stored by sealing the entirety or a part of the periphery with a content such as a liquid or a particle, with an easily openable part formed in a part of the sealed part, wherein the sealing of the easily openable part is formed in a width narrower than the sealing width in the other part of the sealed part, and a narrow width vertical sealing is formed continuously from the narrow width sealed part, elongating in the direction substantially orthogonal thereto into the inside of the container such that the sealing of the easily openable part forms a substantially T shape or a substantially V shape in a plan view.

In the above-mentioned configuration, the end terminal of the narrow width vertical sealing is a part to be a peeling starting end of the openable part in the container of the present invention. In order to prevent inadvertent peel off of the vertical sealing part by the external stress, or the like, in the present invention, dot sealing is formed in one or a plurality in the vicinity of the vertical sealing part end terminal on the extending line of the vertical sealing part so as to restrain peel off of the peeling starting end part of the vertical sealing part end terminal.

In the present invention, the tip end shape of the vertical sealing part is formed sharply in the case peeling with a small pressuring force is desired. In contrast, it is formed in a thick semi round shape in the case peeling with a large pressuring force is desired.

Moreover, the length of the vertical sealing part is formed longitudinally in the case peeling with a small force is desired. In contrast, it is formed shortly in the case peeling with a large pressuring force is desired. Specifically, with the premise that the inner width of the sealing part provided with the easily openable part (width of the storage chamber) is W, the length of the vertical sealing part is selected from a range of about 1/3 W to 1/several W, or less, for example, about 1/10 W, and set. However, the length of the vertical sealing part can be can be changed or set optionally based on the easily openable property (opening convenience) to be obtained, depending on the thickness of the sheet, such as a resin film to be used for the container of the present invention, the material thereof, the property of the substance to be stored, or the like.

In the present invention, by providing the easily openable part of the above-mentioned configurations in the disposable container, it is conceivable that the opened opening part may be enlarged more than needed depending on the size of the pressure of the hands applied on the container. Therefore, according to the present invention, in the sealing shape comprising a substantially T shape, or the like in the plan view of the easily openable part, in order to limit the opening width, the length of the narrow width sealing part is formed substantially same as the width of the part to be opened (opening width). By forming the narrow width sealing part length (width of the opening part) of the easily openable part accordingly, since the peeling and opening operation started from the narrow width vertical sealing part is stopped in the narrow width sealing part of a preset length, the opening width of the easily openable part can be limited to that position.

In the present invention, as to the die for forming the above-mentioned easily openable part, by using one having one side or a part of a sealing operation part in a sealing die for an ordinary notch type openable container replaceable with one side or a part of a sealing operation part formed in a substantially T shape for forming an easily openable part for a container of the present invention, the die cost can be reduced drastically.

DESCRIPTION OF THE PREFERRED EMBODIMENTS

Figure 1:
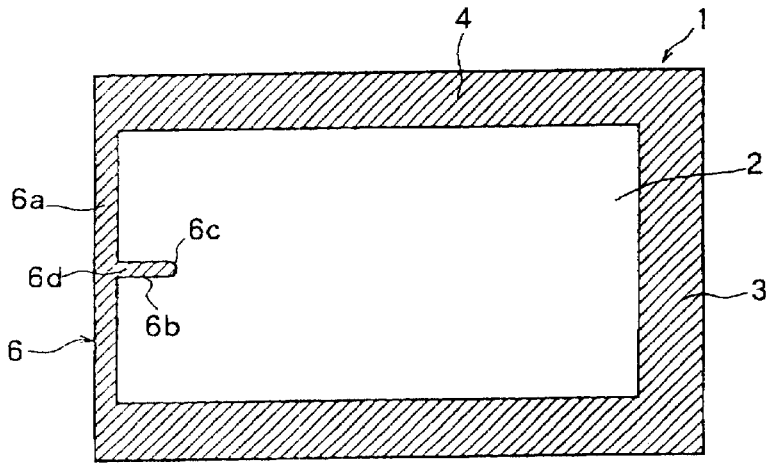
FIG. 1 is a plan cross-sectional view of a first embodiment of an easily openable disposable container of the present invention.
Figure 2:
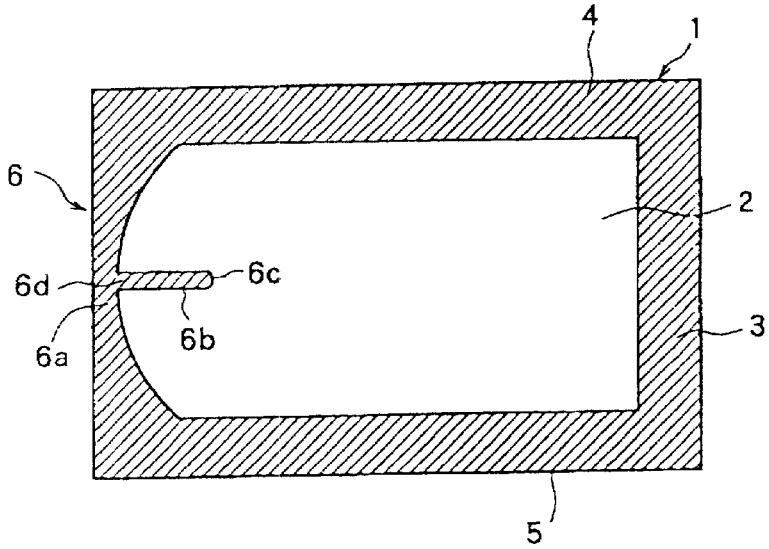
FIG. 2 is a plan cross-sectional view of a second embodiment of a container of the present invention.
Figure 3:
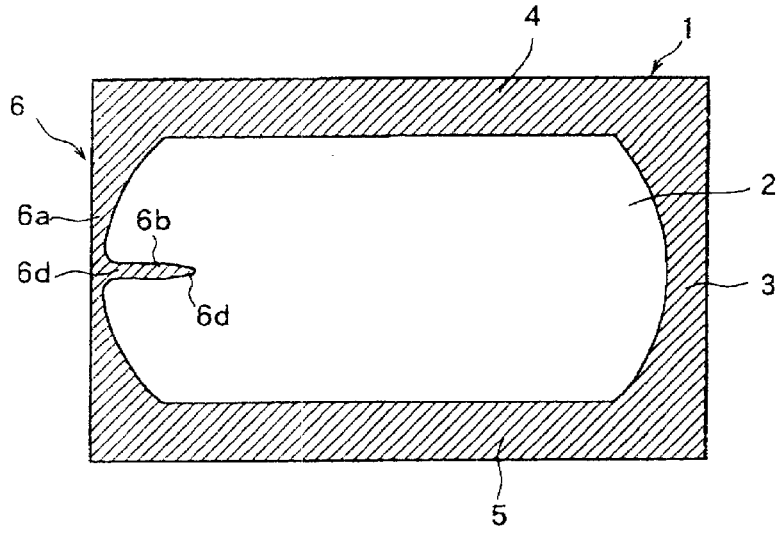
FIG. 3 is a plan cross-sectional view of a third embodiment of a container of the present invention.
Figure 4:
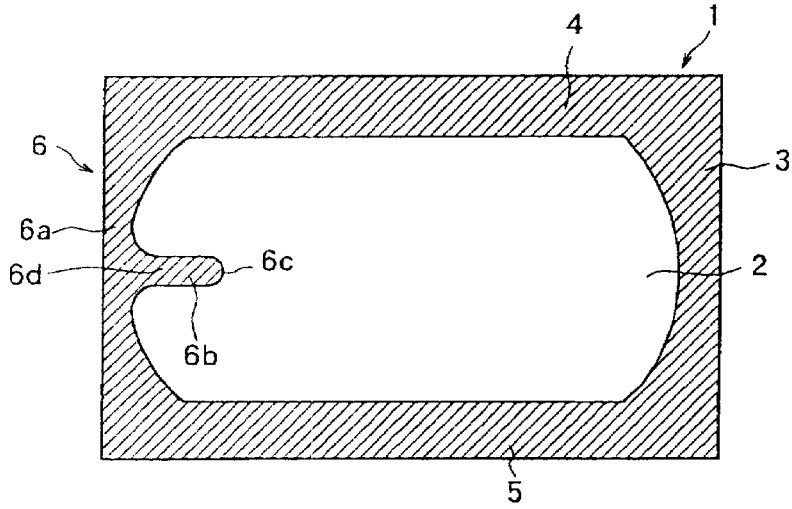
FIG. 4 is a plan cross-sectional view of a fourth embodiment of a container of the present invention.
Figure 5:
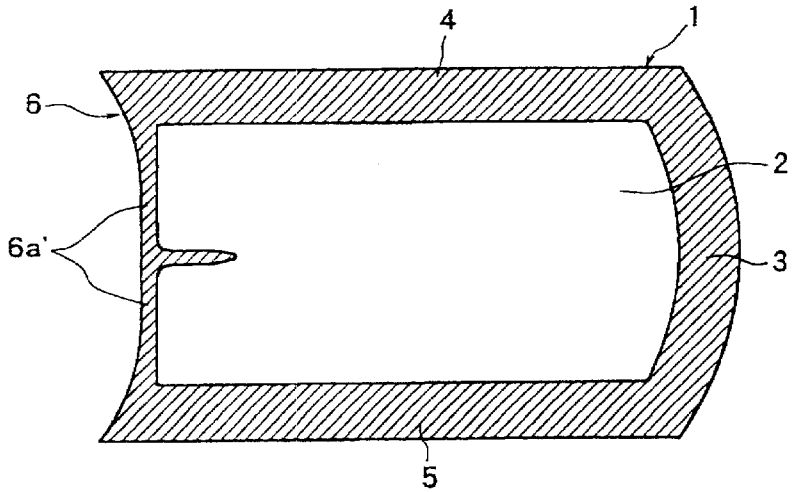
FIG. 5 is a plan sectional view of a first embodiment of a narrow width sealing part for limiting the opening width of an easily openable part.
Figure 6:
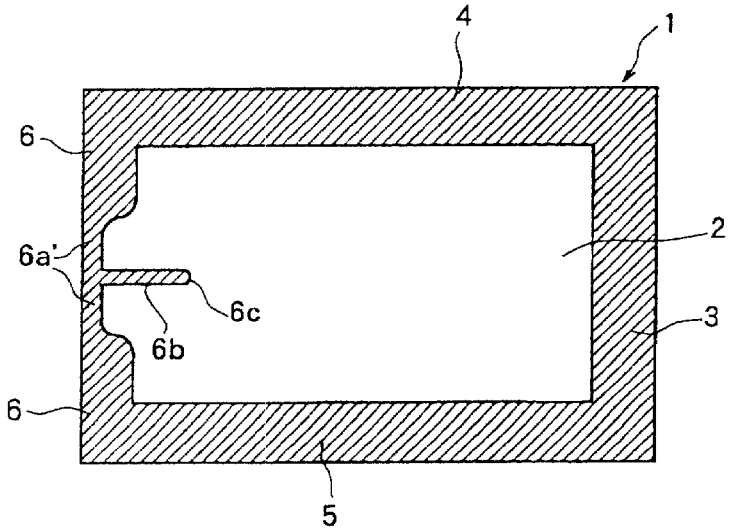
FIG. 6 is a plan cross-sectional view of a second embodiment of a narrow width sealing part for limiting the opening width of an easily openable part.
Figure 7:
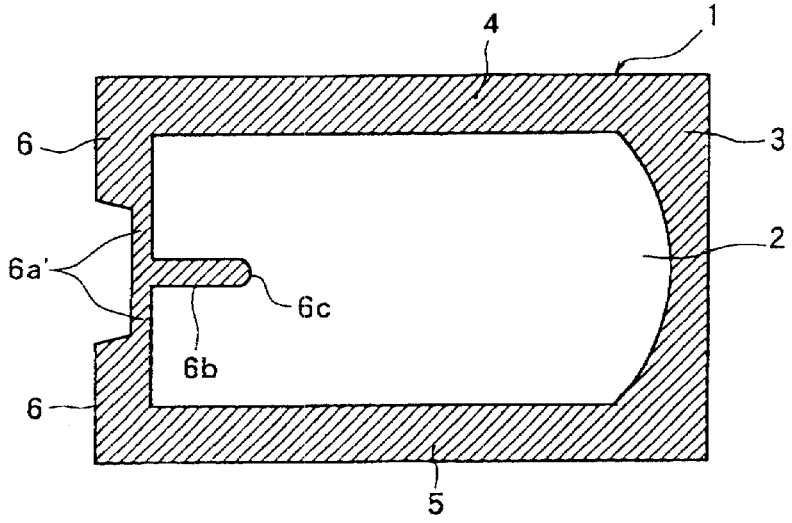
FIG. 7 is a plan cross-sectional view of a third embodiment of a narrow width sealing part for limiting the opening width of an easily openable part.
Figure 8:
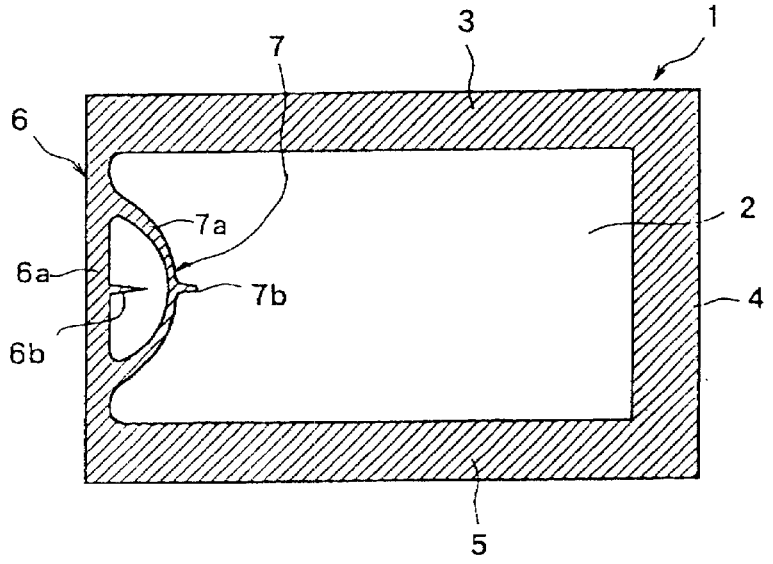
FIG. 8 is a plan cross-sectional view of an eighth embodiment of a container of the present invention.
Figure 9:
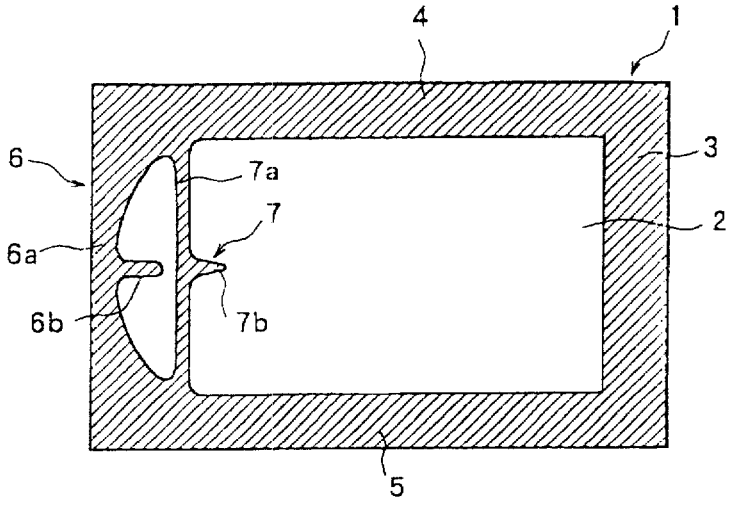
FIG. 9 is a plan cross-sectional view of a ninth embodiment of a container of the present invention.
Figure 10:
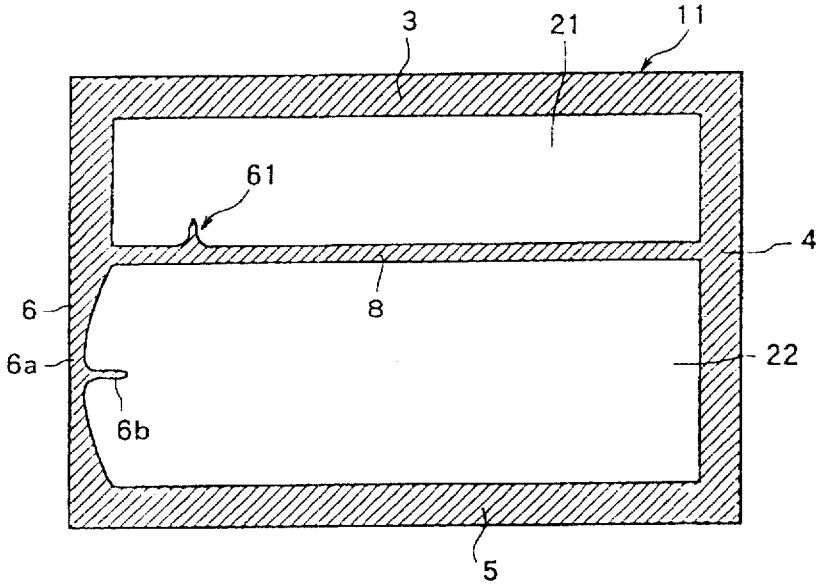
FIG. 10 is a plan cross-sectional view of a tenth embodiment of a container of the present invention.
Figure 11:
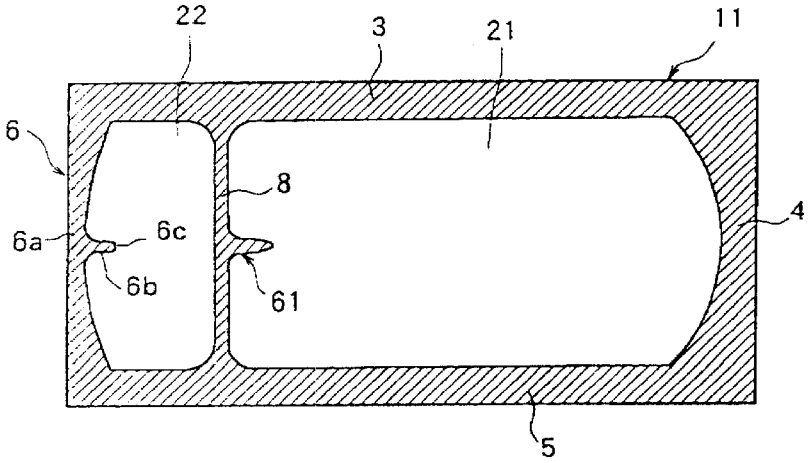
FIG. 11 is a plan cross-sectional view of an eleventh embodiment of a container of the present invention.
Figure 12:
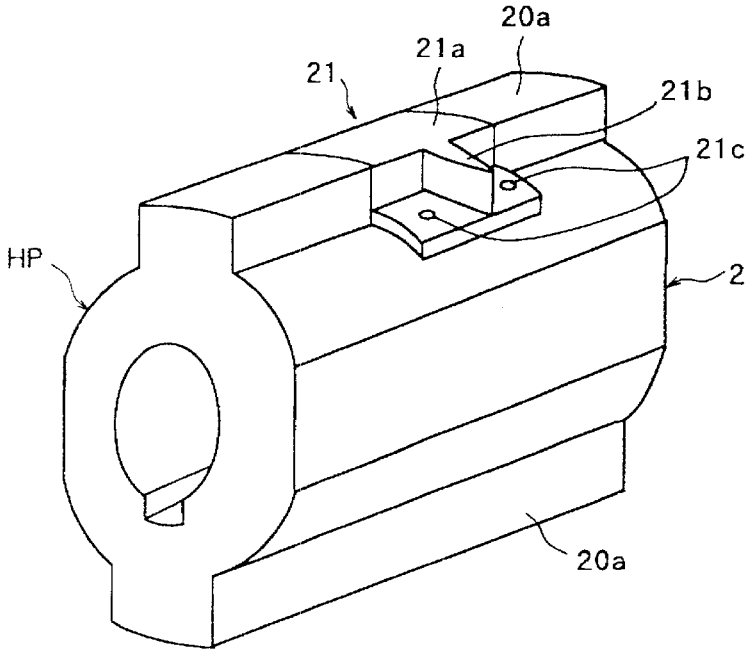
FIG. 12 is a perspective view of an embodiment of a die for lateral sealing, obtained by modifying a conventional die for lateral sealing for lateral sealing of an easily openable part of a container of the present invention.
Figure 13:
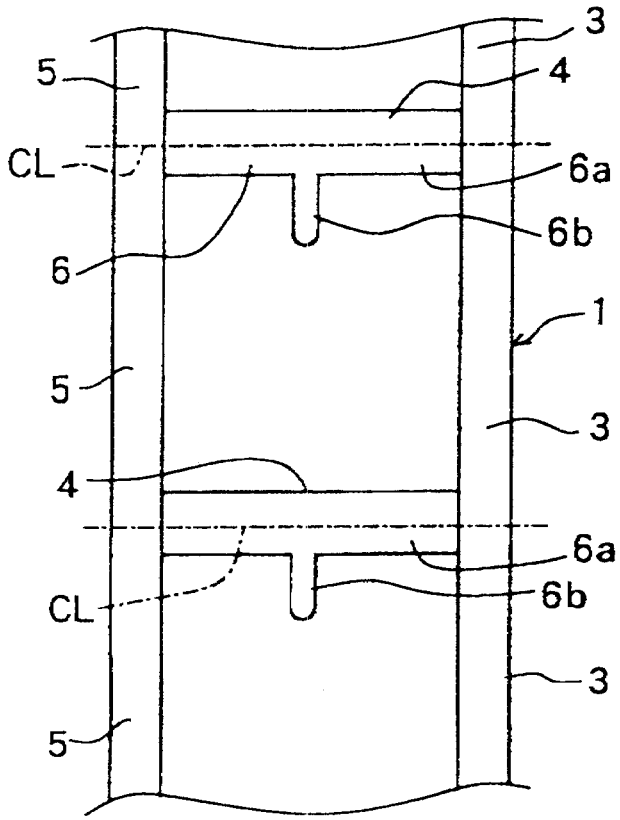
FIG. 13 is a plan view of an embodiment of a container of the present invention, comprising an easily openable part, produced by using the die of FIG. 12.

Next, embodiments of a container of the present invention will be explained with reference to the drawings. FIG. 1 is a plan cross-sectional view of a first embodiment of an easily openable disposable container of the present invention. FIG. 2 is a plan cross-sectional view of a second embodiment of a container of the present invention. FIG. 3 is a plan cross-sectional view of a third embodiment of a container of the present invention. FIG. 4 is a plan cross-sectional view of a fourth embodiment of a container of the present invention. FIG. 5 is a plan sectional view of a first embodiment of a narrow width sealing part for limiting the opening width of an easily openable part. FIG. 6 is a plan cross-sectional view of a second embodiment of a narrow width sealing part for limiting the opening width of an easily openable part. FIG. 7 is a plan cross-sectional view of a third embodiment of a narrow width sealing part for limiting the opening width of an easily openable part. FIG. 8 is a plan cross-sectional view of an eighth embodiment of a container of the present invention. FIG. 9 is a plan cross-sectional view of a ninth embodiment of a container of the present invention. FIG. 10 is a plan cross-sectional view of a tenth embodiment of a container of the present invention. FIG. 11 is a plan cross-sectional view of an eleventh embodiment of a container of the present invention. FIG. 12 is a perspective view of an embodiment of a die for lateral sealing, obtained by modifying a conventional die for lateral sealing for lateral sealing of an easily openable part of a container of the present invention. FIG. 13 is a plan view of an embodiment of a container of the present invention, comprising an easily openable part, produced by using the die of FIG. 12.

In FIGS. 1 to 4, the numeral 1 represents an easily openable disposable container having a flat rectangular shape according to the present invention, produced by superimposing two film-like sheet materials, such as a synthetic resin film, or an aluminum foil laminated on the film, or synthetic resin films laminated with each other, or films of other materials laminated with each other, and sealing the circumference thereof into, for example, a quadrilateral shape by a bonding method, such as heat sealing, for storing a content such as a liquid in a storage part 2 of the container 1. In the present invention, the above-mentioned container of the present invention may be formed by folding a sealing material in two. In this case, as the sealing part, three parts (three sides) except the part folded in two are sealed.

In the above-mentioned container 1, among the peripheral sealing parts 3, 4, 5, 6 since an easily openable part according to the present invention is formed in the sealing part 6, the sealing part 6 with the easily openable part in the container 1 will be explained below. Although it is not shown in the figure, in the three side sealing type container 1, with one sheet folded in two, the easily openable part to be explained below will be formed in one of the three sealing parts.

In the container 1, the other sealing parts 3, 4, 5 except the sealing part 6 are sealing parts of the same embodiment as known containers of this kind. However, the sealing part 6 has a narrow width sealing part 6*a* formed with a sealing width narrower than that of the other sealing parts 3 to 5 for providing an easily openable part as well as a narrow width vertical sealing part 6*b* (shown in the figure laterally) elongating to the inner side in a storage part 2 in the container formed so as to form the easily openable part. The end terminal thereof in the narrow width vertical sealing part 6*b* can function as a peeling starting part 6*c* by providing a sharp, square, or round sealing contour. The sealing widths of the narrow width sealing part 6*a* and the narrow width vertical sealing part 6*b* are formed such that that of the vertical sealing part 6*b* is at most same as, or narrower than that of 6*a*. Hereinafter, the narrow width vertical sealing part 6*b* will be referred to simply as the vertical sealing part 6*b*.

In the case a liquid seasoning is stored in the storage part 2 of the container of FIG. 1 as an example of the content, and the periphery there of is formed with the above-mentioned sealing parts 3 to 5 of an ordinary embodiment and the sealing part 6 with the easily openable part formed, in order to take out the content to the outside of the container 1, with the container 1 grabbed by fingers, the storage part 2 is pressured strongly from above and below. The pressuring force functions on all the sealing parts 3 to 6 through the content. As to the sealing part 6 having the easily openable part, the seal of the peeling starting part 6*c* as the end terminal of the vertical sealing part 6*b* elongating into the storage part 2 starts to be peeled off.

When the seal of the end terminal of the vertical sealing part 6*b* starts to be peeled off, the peeled part is gradually enlarged to a base end part 6*d* of the vertical sealing part 6*b* so as to finally peel off the seal of the narrow width sealing part 6*a* provided continuously with the base end part so that the container 1 is opened at the part 6*a*.

FIG. 2 shows an embodiment having the width of the narrow width sealing part 6*a* to be the easily openable part formed narrowly only in the vicinity of the center part thereof and gradually widened to the outward. The vertical sealing part 6*b* is formed longer than the case of FIG. 1. Since the vertical sealing part 6*b* is provided longer, the end terminal 6*c* of the vertical sealing part 6*b* can easily be peeled off even with a small pressuring force as well as since the narrow width sealing part 6*a* has a sealing embodiment with the sealing width widened toward the outward direction, the wide width sealing part at the outer sides can hardly be opened, the effect of limiting the opening width can also be provided.

Moreover, according to the present invention, as shown in FIG. 3 and FIG. 4, by changing the width of the vertical sealing part 6*b*, the sealing part 6 of the container 1 can be formed such that it can be opened with a small pressuring force for taking out the content, or it can be opened only with a large pressuring force. FIG. 3 shows an embodiment of the container 1 to be opened with a small pressuring force by forming the vertical sealing part 6*b* with a narrower width, and FIG. 4 shows an embodiment of the container 1 to be opened only by applying a large pressuring force. In FIGS. 1 to 4, the same numerals represent the same parts, and the same members.

Also in the embodiments of FIG. 3 and FIG. 4, according to the sealing embodiment of the narrow width sealing part 6*a*, that is, by gradually widening the sealing width of the part 6*b* to the right and left outward directions from the vertical sealing part 6*b* at the center, the effect of preventing spread of the opening width of the easily openable part to the entirety of the width of the container 1, however, the opening width to be limited depends on the pressure to be applied, and thus it can hardly be constant.

Therefore, in the present invention, in order to limit the opening width substantially constantly regardless of the size of the opening pressure to be applied, a narrow width sealing part 6*a*' shown in the embodiments in FIG. 6 and FIG. 7 is formed. The narrow width sealing part 6*a*' is provided such that the narrow width sealing part 6*a*' is formed in a width (length) for opening on the right and left outer sides from the vertical sealing part 6*b* at the center, and the remaining part is formed as the ordinary width sealing part 6. FIG. 6 and FIG. 7 show the embodiments with the part with the sealing width difference of the narrow width sealing part 6*a* and the ordinary width sealing part 6 provided on the external periphery side of the container 1, or on the internal periphery side of the container 1. FIG. 5 shows an embodiment with different container 1 external shape and sealing part embodiment. In FIGS. 5 to 7, the numerals same as those in FIGS. 1 to 4 represent the same parts.

As heretofore explained, since the container 1 of the present invention has a mechanism for opening the container 1 by starting the peel off of the sealing part from the end terminal 6*c* of the vertical sealing part 6*b* and enlarging the peel off to the narrow sealing part 6*a* by applying the pressuring force to the storage part 2 with the fingers, there is a risk of inadvertent opening in the case a force not aiming at opening, such as the weight at the time of packaging or transportation, is applied.

In order to prevent generation of the accident, according to the present invention, although it is not shown in the figure, a dot sealing part can be provided in at least one or two or more parts on the extension line from the end terminal 6*c* of the vertical sealing 6*b*, or in the vicinity of the end terminal 6*c* for protecting the easily peeling property of the end terminal 6*c*.

Moreover, for the same purpose as mentioned above, as shown in FIG. 8 and FIG. 9, a buffer sealing part 7 can be formed in the storage part 2 with respect to the vertical sealing part 6*b* in the sealing part 6 with the easily openable part formed. In the embodiment of FIG. 8, an arch-like sealing part 7*a* is formed surrounding the vertical sealing part 6*b* in the container 1 of FIG. 1, and a vertical sealing part 7*b* serving as the same peeling starting part as the end terminal 6*c* of the vertical sealing part 6*b* is formed at the center part thereof. In the embodiment shown in FIG. 9, a linear sealing part 7*a* is formed so as to cover the vertical sealing part 6*b* of FIG. 3 and FIG. 4, with the vertical sealing part 7*b* formed in the center part thereof.

By providing the sealing parts 6, 7 in the two stage structure each comprising the easily openable part provided doubly with respect to the storage part 2, since only the sealing part 7 disposed in the inner side of the storage part 2 is opened even in the case a pressuring force other than a pressuring force for opening is applied, leakage of the content to the outside of the container 1 can be prevented even in the case an external stress by the weight or the impact is applied at the time of packaging or transportation.

The sealing structure shown in FIG. 8 and FIG. 9 not only prevent inadvertent opening by application of the external force but also it is effective for preventing scattering of the content. That is, by providing the opening part of the container 1 in the double structure with the easily openable part, the easily openable part cannot be opened immediately after application of the pressuring force so that the content therein cannot be pushed out as it is to the outside of the container.

The above-mentioned easily openable part structure of the present invention can be used preferably for a container of an adhesive used after mixing two or three liquids. This case will be explained with reference to FIG. 10 and FIG. 11. In FIG. 10 and FIG. 11, the sealing part 6 with the easily openable part formed is provided on one side of the sealed external periphery of the container 1 as in the embodiments of FIG. 1 to FIG. 7. However, in the embodiments of the container 1 shown in FIG. 10 and FIG. 11, a section sealing part 8 of a narrow width sealing is formed for forming the storage part 2 in two chambers or three chambers, with a narrow width vertical sealing part 61 to be the peeling starting part of sealing at the substantially same easily openable part as that in the above-mentioned embodiments formed in the narrow width section sealing part 8. By forming the container 1 accordingly, two storage parts 21, 22 can be formed in a container in the embodiments shown in the figure, and although it is not shown in the figure, three or more storage parts can be formed, and thus by storing predetermined contents in each storage part 21, 22 and sealing all the sealing parts 3 to 6, 8, two kinds of the contents can be stored in the storage parts 21, 22 independently in the container 11.

By opening the vertical sealing part 61 as the easily openable part and a part of the sealing part 8 on both sides thereof by pressuring the first storage part 21, the content in the storage part 21 and the content in the second storage part 22 can be mixed. And by pressuring the entirety of the first storage part 21 and the second storage part 22 in this state for opening the sealing part 6 comprising the easily openable part by the two sealing parts 6*a*, 6*b*, the stored substance as a mixture of the two stored substances can be pushed out from the opened part in the sealing part 6 of the second storage part 22. In the above-mentioned two chamber or multiple chamber type container of the present invention, a structure provided with an easily openable part capable of pushing out the content independently from each storage part can be adopted. Moreover, of course the container of U.S. patent application Ser. No. 10/040,432the present invention heretofore explained can be adopted also in a container formed by having one of the sheet materials comprising the container as a hard one, superimposing a soft sheet on the hard sheet, and sealing the periphery.

The above-mentioned sealing structure of the present invention can be provided by modifying a conventionally known notch opening type container sealing die, or newly producing so as to be used as a sealing die for a container of the present invention, and this point will be described below.

For the conventional notch opening type containers, a continuous filling type sealing die comprises a sealing die including a rotation type vertical sealing type die for forming a longitudinal sheet cylindrically, and a rotation type lateral sealing die for sectioning the cylindrical sheet into predetermined vertical storage chambers to be optionally set, by sealing the right and left ends of the sheet in the vertical direction while feeding a longitudinal sheet disposed doubly above in the vertical direction intermittently or continuously.

Therefore, in the present invention, in the above-mentioned die, the entirety of a part of a sealing function projection part 20*a* of a lateral sealing die HP shown in FIG. 12 is provided in a detachable structure with a vis, or the like so that a sealing function projection part 21 with the same shape as that of the sealing part 6 to be the easily openable part of the container 1 of the present invention shown in FIG. 13 is mounted in place of the above-mentioned projection part 20*a* preliminarily detached. In the sealing function projection part 21 of FIG. 12, the numeral 21*a* represents a part corresponding to the narrow width sealing part 6*a*, the numeral 21*b* represents a part corresponding to the vertical sealing part 6*b*, and the numeral 21*c* represents a mounting vis. According to the configuration, since the container 1 having the easily openable part of the present invention can be produced as shown in FIG. 13 with a sealing die used for production of the conventional containers, drastic reduction of the die cost can be achieved. In FIG. 13, the mark CL represents a continuous cut line for the container 1. In the above-mentioned description, by forming the upper surface of the projection part 21 slightly lower than the upper surface of the existing sealing projection part 20*a*, the projection part 21 can be contacted with the part of the sheet for forming the easily openable part with a contact pressure slightly lower than the contact pressure of the existing projection part 20*a* with respect to the other part of the sheet, the sealing strength thereof is provided lower than the sealing strength in the other part, and thus the easily openable property of the easily openable part can further be ensured.

In the above-mentioned description, although the sealing part for forming the easily openable part is formed in a lateral sealing part, the easily openable part can be formed in the vertical sealing part 3 or 5 in the container 1. Also in this case, of course the conventional sealing die can be modified as in the above-mentioned embodiment. Moreover, as to the container shape, although only rectangular ones are shown in the figures, the present invention can be adopted also for various container shapes other than a rectangle, such as a polygon, a circle, a long circle, and an ellipse.

As heretofore explained, since the present invention provides an easily openable disposable container with an easily openable function, comprising a sheet such as a synthetic resin film or a film-like sheet with an aluminum foil laminated on the film for sealing the substance to be stored by sealing the entirety or a part of the periphery with a content such as a liquid or a particle, with an easily openable part formed in a part of the sealed part, wherein the sealing of the easily openable part is formed in a width narrower than the sealing width in the other part of the sealed part, and a narrow width vertical sealing is formed continuously from the narrow width sealed part, elongating in the direction substantially orthogonal thereto into the inside of the container such that the sealing of the easily openable part forms a substantially T shape or a substantially V shape in a plan view, the sealing die structure can be provided extremely simply so as to contribute to drastic reduction of the cost therefore as well as prevention of scattering of the content and limitation of the opening width can be achieved, and furthermore, the effect of sealing without adherence of the content on the sealing part even in the case of submerged sealing can be obtained.

What is claimed is:

1. An easily openable disposable container comprising:

a sheet of synthetic resin film or a sheet of film with an aluminum foil laminated thereon, the sheet having a sealed or partly sealed periphery to form sealed sides having a sealing width, which form a storage chamber containing a liquid or particles;

one of the sealed sides having an easily openable part with a sealing width narrower than the sealing width of the other sides; and a narrow width vertical seal, having a single base end part, formed continuously from the easily openable part, the vertical seal extending orthogonal to the easily openable part into the storage chamber of the container, such that the vertical seal easily openable part has a substantially T-shape in plan view.

2. The easily openable disposable container according to claim 1, wherein a terminal end of the vertical seal is one of a sharp end and a rounded end.

3. The easily openable disposable container according to claim 1, wherein the vertical seal of one container is different in length than that of another container.

4. The easily openable disposable container according to claim 1, wherein the sealing width of the easily openable part is narrower only at a location adjacent the vertical seal.

* * * * *